US006807780B2

(12) United States Patent
McCahill et al.

(10) Patent No.: US 6,807,780 B2
(45) Date of Patent: Oct. 26, 2004

(54) REINFORCEMENT PLATE FOR A STRUCTURAL MEMBER

(76) Inventors: Robert J. McCahill, 186 S. Dawson Dr., Camarillo, CA (US) 93012; Ronald T. Nugroho, 6353 Capricorn Ave., Agoura, CA (US) 91301

( * ) Notice: Subject to any disclaimer, the term of this patent is extended or adjusted under 35 U.S.C. 154(b) by 58 days.

(21) Appl. No.: 10/226,984

(22) Filed: Aug. 23, 2002

(65) Prior Publication Data

US 2003/0042371 A1 Mar. 6, 2003

Related U.S. Application Data

(60) Provisional application No. 60/314,444, filed on Aug. 24, 2001.

(51) Int. Cl.[7] ..... E04C 2/52

(52) U.S. Cl. ..... 52/220.8; 52/696; 52/61; 248/300; 248/906

(58) Field of Search ..... 52/220.1, 220.8, 52/696, 712, 61, 62; 248/57, 200.1, 300, 906; 362/365

(56) References Cited

U.S. PATENT DOCUMENTS

| | | | | | |
|---|---|---|---|---|---|
| 2,936,979 | A | * | 5/1960 | Epstein | 248/57 |
| 2,965,342 | A | * | 12/1960 | Goldstone | 248/57 |
| 3,105,664 | A | * | 10/1963 | Poradun | 248/56 |
| 3,481,571 | A | * | 12/1969 | Lauckner | 248/57 |
| 3,684,220 | A | | 8/1972 | Logsdon | |
| 4,108,087 | A | * | 8/1978 | Sebesta | 109/51 |
| 4,122,647 | A | * | 10/1978 | Kovar | 52/695 |
| 4,293,895 | A | * | 10/1981 | Kristofek | 362/147 |
| 4,408,262 | A | * | 10/1983 | Kusmer | 362/147 |
| 4,659,051 | A | * | 4/1987 | Propp et al. | 248/546 |
| 4,946,117 | A | | 8/1990 | Liesegang | |
| 5,230,190 | A | | 7/1993 | Schuette | |
| 5,370,345 | A | | 12/1994 | Condon | |
| 5,519,977 | A | * | 5/1996 | Callahan et al. | 52/712 |
| 5,546,716 | A | | 8/1996 | Broxterman | |
| 5,625,995 | A | * | 5/1997 | Martin | 52/715 |
| D417,135 | S | | 11/1999 | McMahon | |
| 6,543,186 | B2 | * | 4/2003 | Gilleran | 52/35 |
| 6,582,106 | B2 | * | 6/2003 | Jamison | 362/396 |
| 2003/0042371 | A1 | * | 3/2003 | McCahill et al. | 248/57 |

* cited by examiner

*Primary Examiner*—Carl D. Friedman
*Assistant Examiner*—Chi Q. Nguyen
(74) *Attorney, Agent, or Firm*—Kenneth J. Hovet; Paul Chancellor

(57) ABSTRACT

A plate to reinforce a shear panel that has been weakened by an opening extending through the panel is provided. The plate is selected to have a shear load capacity greater than the shear panel without the opening. The plate has a plate opening similar to the panel opening, and is secured to the panel with a predetermined strength and arrangement of panel fasteners. The plate is sized to fit between adjacent structural members. Opposing side flanges extend outwardly from the plate. Flange fasteners of predetermined strength and spacings are used to secure the flanges to the structural members.

20 Claims, 2 Drawing Sheets

REINFORCEMENT PLATE FOR A STRUCTURAL MEMBER

This application claims priority from Provisional Patent Application No. 60/314,444, filed Aug. 24, 2001.

BACKGROUND OF THE INVENTION

FIELD OF THE INVENTION

The present invention pertains generally to structural members used in the construction of buildings. More particularly, the present invention pertains to a reinforcement plate which can be quickly and easily attached to weakened portions of a construction assembly to allow for further construction without having to verify that the assembly still has sufficient structural integrity to perform its intended function.

DESCRIPTION OF THE RELATED ART

Structural members, such as wooden 2×4's, that are used in the construction of buildings, are well-known in the prior art. Shear panels are also known for reinforcing the shear strength of stud assemblies that typically form wall structures. To do this, the shear panel (usually a sheet of plywood) is positioned across the sides of spaced-apart upstanding studs, and fixed to the studs with fasteners such as nails, bolts or screws. This arrangement increases the resistance of the overall building structure to shear forces.

Occasionally, openings must be established in the shear panel during construction of a building to allow for wiring, ducting, plumbing and other building materials to pass through the shear panel. However, the existence of any holes or openings in the shear panel weakens the resistance of the panel to shear forces. Accordingly, once an opening in a panel has been formed, the panel must be reinspected to verify that the remaining portion of the panel has sufficient structural integrity for performing its intended function.

Most localities have defined regulations that govern the requirements for reinspection of weakened structural members, before construction can continue. These requirements almost always include an on-site inspection of the affected area by a qualified professional such as a civil engineer or structural engineer. This verification process can be very expensive and time-consuming. What is desired is a reinforcement device and method of using the device which will permit the formation of openings in shear panels without requiring on-site verification that sufficient structural integrity of the shear panel is still present.

U.S. Pat. No. 5,546,716, which issued to Broxterman et al, discloses a joist bridge wherein a plate is formed with an opening to allow ducting to pass therethrough. The plate is attached to two adjustable members, which are further bolted to spaced-apart joists in a housing construction. The adjustable members of Broxterman et al, however, are not integral to the plate. Accordingly, the adjustable members can become loose from the plate and thereby become unsuitable for placement between adjacent studs to reinforce a weakened shear panel.

U.S. Pat. No. 5,230,190, which issued to Schuette for an invention entitled "Joist Bridge And Duct Support," describes a duct support device wherein a centrally located duct support frame is supported by a plurality of support arms that merge into rectangularly arranged walls. Foot and shoulder structures extend outwardly from two opposing walls, and a corresponding flange extends even further outwardly from each opposing foot. For installation, the device is press-fit between two adjoining joists, so that the flanges rest on the upper horizontal surface of the joists.

The device disclosed by Schuette, however, is not appropriate for installation between studs (or to the shear panel). This is because the extending flanges prevent the device from fitting between two vertically oriented studs in a manner that allows for attachment of the device to the studs. A further disadvantage of the Schuette device is that the span-and-bridge structure of the duct support member, support arms, walls, feet, shoulders and flanges is relatively complex, particularly for a device that is probably best suited for mass production. Accordingly, the Schuette device may be difficult to manufacture in an economically feasible manner.

SUMMARY OF THE INVENTION

In light of the prior art disadvantages, it is an object of the present invention to provide a reinforcement plate for a construction assembly which allows for quick and efficient attachment. Another object of the present invention is to provide a plate which reinforces weakened portions of shear panels in a building structure. Another object of the present invention is to provide a reinforcement plate which allows for the placement of duct openings in a shear panel without requiring the shear panel to be reinspected for proper structural integrity. Yet another object of the present invention is to provide a reinforcement plate having a plate opening surrounded by attachment apertures for using fasteners as a securement means. Still further, the invention provides a reinforcement plate with side flanges having flange openings for fixing the reinforcement plate to spaced-apart structural members.

BRIEF DESCRIPTION OF THE DRAWINGS

The novel features of this invention will be best understood from the accompanying drawings, taken in conjunction with the accompanying description, in which similar characters refer to similar parts, and in which.

DESCRIPTION OF THE PREFERRED EMBODIMENTS

Figure 2:
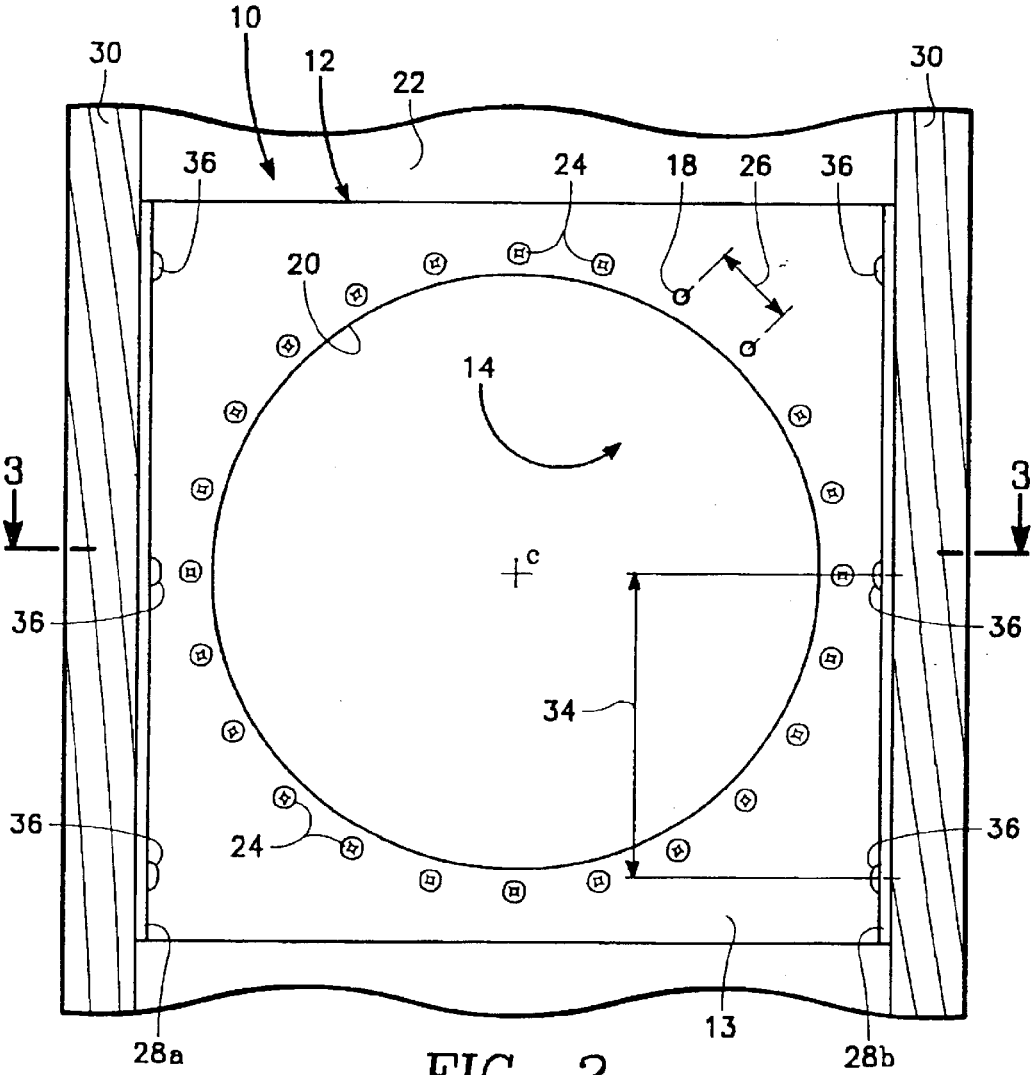
FIG. 2 is a front elevational view of the reinforcement plate of the invention fixed to the shear panel and studs of FIG. 1.

Referring now to the Figures, the reinforcement plate of the present invention is shown and is generally designated by reference character 10. In brief overview, the plate comprises a body portion 12, having an inner face 13 and an outer face 15. It also includes a pair of opposing side flanges 28*a*, 28*b*. Each flange extends outwardly from a respective opposing side edge 27*a*, 27*b* of the plate, as best seen in FIG. 2. The body portion 12 is secured to a shear panel 22, and each side flange is secured to a respective opposing structural member 30, as described below.

Figure 1:
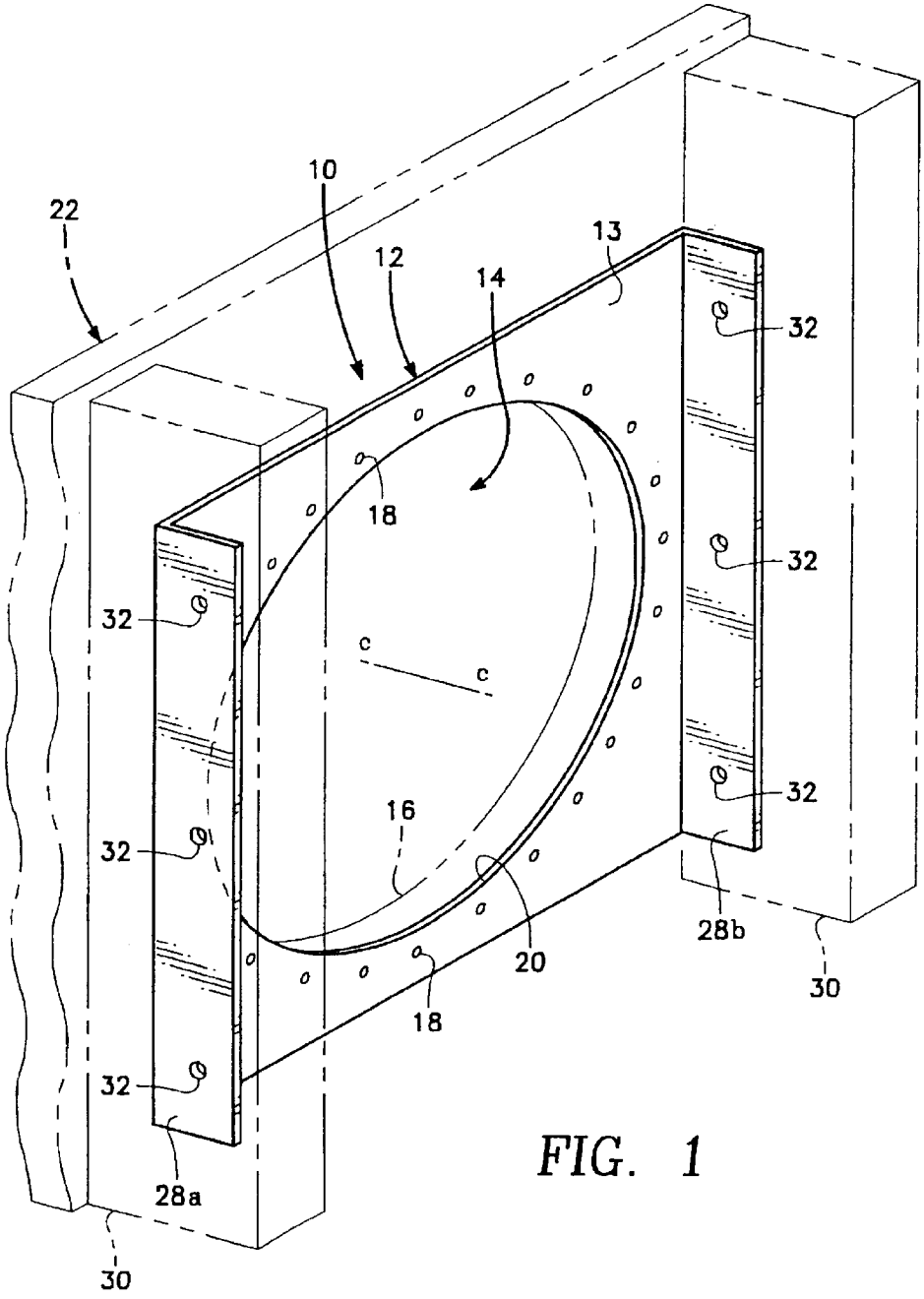
FIG. 1 is a front isometric view of the reinforcement plate of the present invention which positioned between two upstanding structural members, and adjacent to a shear panel, shown in phantom.

The reinforcement plate is provided with a plate opening 14 located proximate the mid-section of body portion 12. The plate opening is in communication with a panel opening 16 formed in shear panel 22 to allow for passage of air ducts, piping, electrical wiring, cables, conduits and the like. To help ensure that shear forces borne by the shear panel proximate the panel opening will be transferred to the reinforcement plate, it is preferred that the plate opening have a size and shape that is about coextensive to the size and shape of the panel opening. In this regard, FIGS. 1 and 2 show the plate and panel openings being circular and coextensive, with a common center axis c,c. However, the openings could have other shapes such as oval, oblong or polygonal in a manner to be described hereinafter.

To further ensure that panel shear forces are effectively transferred to the reinforcement plate, a predetermined series of plate apertures 18 are positioned radially outward from the inner edge 20 of plate opening 14. However, in cases where the plate and panel openings are not coextensive, the apertures in the plate should follow the panel opening outline and be radially outward from that outline. In this way, the plate securement means, such as mechanical fasteners, will be able to pass through the apertures and into desired portions of the shear panel. Preferably, the apertures are spaced-apart from each other an equal distance 26 that is not less than one-half the radius 34 of plate opening 14.

Figure 3:
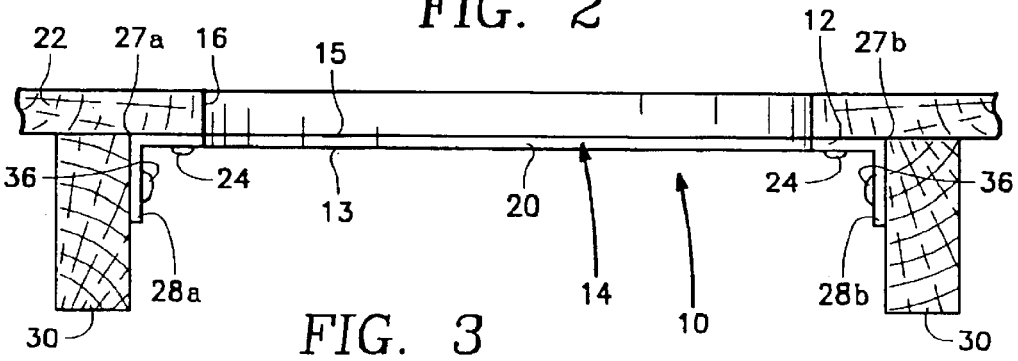
FIG. 3 is a cross-sectional view taken along lines 3—3 of FIG. 2.

As shown in FIGS. 2 and 3, panel fasteners, shown as screws 24, are inserted from inner face 13 through apertures 18 and tightened. This action will secure outer face 15 of the reinforcement plate to the panel. It will be appreciated that adhesives, alone or in combination with mechanical fasteners such as screws, bolts, nails and rivets, could also be used.

The side flanges 28*a*, 28*b* preferably extend inwardly from respective side edges 27*a*, 27*b* in a direction to position them against corresponding attachment surfaces of the structural members in a manner parallel and coextensive to each other from the top to the bottom edges of body portion 12. However, they could be segmented or comprise fixed bracket structures. As shown, the flanges define parallel planes that are spaced-apart a distance that corresponds to the distance between adjacent structural members 30.

Each side flange 28*a*, 28*b* includes a plurality of fastener openings 32 (See FIG. 1) to secure each flange to a respective structural member 30. To ensure a strong connection, it is preferred that the fastener openings be spaced-apart from each other a distance about not greater than the radius 34 of plate opening 17. Flange fasteners, shown as screws 36, are used to secure the flange to the structural member. However, other securement means could be used, as set forth in relation to the panel and plate connection. Once the reinforcement plate is fixed to the shear panel 22 and structural members 30 as described above, the plate will reinforce a shear panel which has been weakened because of an opening in the panel.

An advantage of the reinforcement plate of the present invention lies in the fact that the plate is an add-on structural part and can be used in a construction assembly whenever needed. In such case, the design shear load capacity of the reinforcement plate is independently predetermined by a qualified professional. Consequently, the shear load capacity may be calculated to exceed the design shear strength of a shear panel without a shear panel opening. Therefore, the shear load capacity of the shear panel/plate combination, proximate the panel opening, can be greater than that of the original shear panel, provided the plate is securely fixed to the shear panel and to the adjacent structural members. In this way, the plate assumes any shear load forces that may occur. Moreover, because the plate has already been certified for a predetermined shear capacity (which is greater than that of the shear panel) by a qualified professional, there is no need for further regulatory inspection of the shear panel once the plate is installed. This provides for greatly increased efficiency and economy in building construction.

To predetermine the required shear load capacity of the reinforcement plate, the design shear load capacity of the shear panel must be known. Table A lists different types of plywood shear panels that are common in the construction industry and their design associated shear load capacity.

TABLE A

Shear Load Capacities

| Type of Shear Panel | Shear Capacity in plf |
|---|---|
| Type 10 | 260 |
| Type 11 | 350 |
| Type 12 | 490 |
| Type 13 | 665 |
| Type 14 | 870 |

The Type 14 shear panel will be used to illustrate operation of the reinforcement plate of the present invention and the method of its use.

After selecting the type of shear panel, the required shear load capacity of reinforcement plate 10 may be calculated using the material strength properties of the plate, along with known engineering procedures and formulas. A detailed example of such calculations is shown in Appendix A.

For the present invention, and as stated above, the calculated shear load capacity of a reinforcement plate should be greater than that of the shear panel. Since the shear load capacity of the reinforcement plate is greater than the shear load capacity of the shear panel, the area around the panel becomes reinforced. In fact, that portion of the shear panel proximate the panel opening will have a greater shear capacity than the design capacity of the overall shear panel, once the reinforcement plate is attached.

When fastening the reinforcement plate to the shear panel and structural members, any shear load that might be borne by the panel fasteners 24 and flange fasteners 36 must be considered. To do this, and for an added factor of safety, the aggregate shear load capacity of the panel fasteners must be greater than that of the shear panel itself. Further, the aggregate shear load capacity of the flange fasteners for side flange 28*a* must be greater than that of the shear panel itself. Similarly, the aggregate shear load capacity of the flange fasteners for side flange 28*b* must also be greater than that of the overall shear panel.

In the case of the fasteners 24, the preferred panel fastener is a Strong-Tie® SD#8×1.25 screw manufactured by Simpson Strong-Tie Company. Since the load-bearing capability of the fasteners and that of the design capacity of the shear panel are known, it can be determined how many fasteners are required to fix body portion 12 to shear 22 (Appendix A shows the calculations in greater detail). Once the required number of panel fasteners is determined, the corresponding number and spacing of plate apertures 18 may be determined. For the preferred Strong-Tie® SD#8×1.25 screws, aperture spacing 26 is calculated according to Table B as shown below.

TABLE B

| Aperture Spacings | |
|---|---|
| Type of Shear Panel | Aperture Spacing |
| 10 | 5" |
| 11 | 3½" |
| 12 | 2½" |
| 13 | 2" |
| 14 | 1½" |

Type 10, 11, 12, 13 and 14 shear panels are listed because these are standard plywood shear panels used in the housing construction industry. It is to be appreciated, however, that different aperture spacings can easily be calculated if different types of panels and/or panel fasteners are used, provided the design shear load capacity of the shear panel and the load capacity of the fasteners are known.

With respect to flange fasteners 36, the preferred fastener is a Strong-Tie® SDS ¼×½ screw manufactured by Simpson Strong-Tie Company. In similar fashion to panel fasteners 24, since the load-bearing capability of a flange and the design capacity of the shear panel are known, it can be determined how many fasteners are required to fix side flanges 28*a*, 28*b* to a respective structural member. (Appendix A shows the calculations in greater detail). Once the required number of panel fasteners is determined, the corresponding number and spacing of fastener openings 32 can be determined for each flange.

Although the preferred material for the reinforcement plate is 16 gauge steel, it is to be appreciated that other materials are envisioned for the plate. The envisioned materials include lightweight metals/metal alloys, reinforced polymer resin laminates and industrial plastic materials such as high density polyethylene (HDPE). Any of the above-cited materials could be used, provided the plate has the structure as described above, and further that the portion of the shear panel proximate the panel opening (with the plate attached), has a greater shear capacity than the design shear capacity of the shear panel. Likewise, although the shear panels are typically constructed of plywood, other materials may be used such as plastic, reinforced resin laminates and metals.

As shown in the drawings, plate opening 14 corresponds to the size and shape of shear panel opening 16. However, the size and shape of shear panel opening is chosen according to construction requirements and the design plans for the building under construction. It is to be appreciated, then, that the shape of shear panel opening 16, and the corresponding apertures alignment and/or plate opening, could have various rounded or polygonal outlines without departing from the scope of the present invention. However, it must be possible to predetermine the shear load of the plate with the different opening outline to ensure that it is greater than the design shear capacity of the shear panel.

While the particular reinforcement plate, as herein shown and described in detail, is fully capable of obtaining the objects and providing the advantages above-stated, it is to be understood that the presently preferred embodiments are merely illustrative of the invention.

APPENDIX A

Variables Used in Calculation:

$F_y$=Yield stress of steel plate

E=Modulus of elasticity $K_v$=Shear buckling coefficient $V_n$=Nominal shear strength $\Omega_v$=Factor of safety for shear V=Allowable design shear strength 4/3 =Allowed strength increase factor for wind and seismic design 260, 350, 490, 665, 870 Shear panel design capacities.

For a Full, Continuous Plate:

Use 16 gage plate, $F_y$=50 ksi, t=0,0566"

Design shear wall capacity For a Type 14 Shear Panel= 870 plf.

Length of light gage steel plate=16−1.5=14.5 inch h=14.5", $\sqrt{(Ek_v/F_y)}=\sqrt{29500000(5.34)/5000)}=56.13$ h/t=14.5/0.0566=256.184>1.415)56.13)=79.42

$V_v=0.905Ek_vt^3/h=0.905(29500000)(5.34)(0.0566)^3/14.5=1782.76$ lbs $\Omega_v=1.67$ $V=V_n/\Omega_v=1782.76/1.67=1067.52$ lbs 1067.52(⁴⁄₃) =1423.36 lbs>870(14.5/12)=1051.25 lbs OK For Net Section with a 12" Centerline Hole:

h=(14.5−12)/2=1.25"

$h/t=1.25/0.0566=22.085<0.96\sqrt{(Ek_v/F_y)}=0.96)(56.13)=53.885$ $V_n=0.6F_yht=0.8(50000)(1.25)(0.0566)=2122.5$ lbs $V=V_n/\Omega_v=2122.5/1.67=1270.96$ lbs 1270.96(4/3)(2)=3389.23 lbs>1051.25 lbs OK For Attachment of the Plate to Studs Using Simpson SDS¼×1½ Screws or an Equivalent:

Capacity per screw =268(4/3)=357.33 lbs 1051.25/357.33=2.94, which is rounded up to 3

Therefore, use 3 SDS¼×1½ uniformly spaced screws per flange.

For Attachment of the Plate to a Shear Panel Using Simpson SD8×1.25 screws or an Equivalent:

Screw capacity=76)(4/3)−101.33 lbs adjust for diaphragm action=101.33(1.1)=111.47 lbs Shear Panel Fastener Spacing:

Type 10 panel: (111.47/260)12=5.14", say 5" o.c

Type 11 panel: (111.47/350)12=3.82". say 3.5" o.c.

Type 12 panel: (111.47/490)12=2.73", say 2.5" o.c.

Type 13 panel: (111.47/665)12=2.01", say 2" o.c.

Type 14 panel: (111.47/870)12=1.54", say 1.5" o.c.

We claim:

1. In a construction assembly comprising two spaced-apart structural members which are interconnected by a shear panel having a panel opening, wherein the improvement comprises:

a reinforcement plate comprising a body portion having an outer face and an inner face and opposing side edges;

a plate opening extending through said body portion, said plate opening defined by an inner edge;

a plurality of apertures extending through said body portion which are located radially outward from said inner edge;

a flange extending inwardly from each of said side edges with fastener openings extending through each flange;

said reinforcement plate being positioned between said structural members so that each flange is adjacent to a respective structural member and said outer face is against said shear panel, said panel opening and plate opening being in communication with each other; and securement means for fixing said reinforcement plate to said shear panel and said flanges to said structural members.

2. The assembly of claim 1 wherein said securement means comprises a member selected from any one or combination of a screw, bolt, nail, rivet and adhesive.

3. The assembly of claim 2 wherein said flanges extend about ninety degrees from said side edges into engagement with a respective structural member.

4. The assembly of claim 1 wherein said apertures are about equally spaced-apart.

5. The assembly of claim 1 wherein the number of said apertures is determined in relation to the required shear capacity of said shear panel.

6. The assembly of claim 5 wherein said panel opening is defined by an outline and each of said apertures is radially offset about an equal distance from said outline of said reinforcement plate inner edge.

7. The assembly of claim 1 wherein said panel opening and said plate opening have center axes that are coextensive.

8. The assembly of claim 7 wherein said panel opening and plate opening each have about identical shapes.

9. The assembly of claim 1 wherein said plate opening has a radius and the fastener openings in each flange are spaced-apart a distance about equal to said radius.

10. The assembly of claim 9 wherein said plate opening has a center axis and each flange has a fastener opening in horizontal alignment with said enter axis.

11. A method in a construction assembly to reinforce a shear panel that interconnects spaced-apart structural members, said shear panel having panel opening comprising:

A. Providing a reinforcing plate having a shear strength that will be effective for said construction assembly;

B. Forming a plate opening in said reinforcing plate;

C. Placing said reinforcing plate against said shear panel and between said spaced-apart structural members;

D. Orienting said reinforcing plate so that said plate opening is in communication with said panel opening; and, E. Securing said reinforcing plate to said shear panel.

12. The method of claim 11 including the steps of:

prior to step C, applying an effective adhesive to said reinforcing plate and/or shear panel; and, allowing said adhesive to cure.

13. The method of claim 11, including the steps of:

G. After step B, forming in said plate a plurality of apertures at spaced-apart positions radially outward from said plate opening;

H. During step D, positioning said apertures so that said apertures overlie a surface of said shear panel; and, I. Carrying out step E by inserting fasteners through said apertures into said shear panel and tightening said fasteners.

14. The method of claim 11 wherein said reinforcing plate has opposing side edges from which extend a respective flange, including the step of:

J. After step D, securing each flange to a respective structural member.

15. The method of claim 14 wherein each flange has at least three fastener openings and step J is carried out by inserting a fastener through each fastener opening, then into said structural member and tightening the fastener.

16. The method of claim 15 wherein said plate opening has a radius and said fastener openings are spaced-apart from each other a distance about equal to said radius.

17. In a shear panel that is connected to spaced-apart structural members, said shear panel having a panel opening defined by an outline, wherein the improvement comprises:

a reinforcing plate having a shear strength that is effective to reinforce said shear panel in accordance with predetermined construction design requirements;

a plate opening in said reinforcing plate that about corresponds said outline; and, said plate being fixed to said shear panel so that said panel opening and plate opening are about coextensive, said reinforcing plate having outwardly extending flanges that are fixed to said structural members.

18. The shear panel of claim 17 including a series of spaced-apart apertures extending through said reinforcing plate radially outward about an equal distance from said plate opening.

19. The shear panel of claim 17 wherein said plate opening has a radius and said apertures are spaced-apart from each other a distance less than about one-half said radius.

20. The shear panel of claim 17 wherein said plate opening has a radius and each of said flanges has fastener openings which are spaced-apart from each other a distance about not greater than said radius.

* * * * *